US005877128A

United States Patent [19]

Greer

[11] Patent Number: 5,877,128

[45] Date of Patent: Mar. 2, 1999

[54] CATALYZED LUBRICANT ADDITIVES AND CATALYZED LUBRICANT SYSTEMS DESIGNED TO ACCELERATE THE LUBRICANT BONDING REACTION

[75] Inventor: F. Conrad Greer, Fort Worth, Tex.

[73] Assignee: Platinum Research Organization Ltd., Fort Worth, Tex.

[21] Appl. No.: 639,196

[22] Filed: Apr. 26, 1996

[51] Int. Cl.[6] ..... C10M 125/00; C10M 141/00

[52] U.S. Cl. ..... 508/113; 508/123; 508/126; 508/150; 508/167; 508/181

[58] Field of Search ..... 508/123, 126, 508/150, 167, 181, 113

[56] References Cited

U.S. PATENT DOCUMENTS

| | | | |
|---|---|---|---|
| 2,230,654 | 2/1941 | Plunkett . | |
| 2,510,112 | 6/1950 | Holbrook . | |
| 2,993,567 | 7/1961 | Schackner . | |
| 3,194,762 | 7/1965 | Browning et al. . | |
| 3,247,116 | 4/1966 | Reiling . | |
| 3,314,889 | 4/1967 | Christian . | |
| 3,432,431 | 3/1969 | Mitacek . | |
| 3,493,513 | 2/1970 | Petriello . | |
| 3,536,624 | 10/1970 | Christian . | |
| 3,567,521 | 3/1971 | Toy et al. . | |
| 3,592,700 | 7/1971 | Toy . | |
| 3,607,747 | 9/1971 | Ishikawa et al. . | |
| 3,640,859 | 2/1972 | Messina et al. . | |
| 3,723,317 | 3/1973 | Ulery . | |
| 3,806,455 | 4/1974 | Siegart et al. . | |
| 3,909,431 | 9/1975 | Figiel . | |
| 3,933,656 | 1/1976 | Reick . | |
| 3,969,233 | 7/1976 | Lucas . | |
| 4,029,870 | 6/1977 | Brown et al. . | |
| 4,036,718 | 7/1977 | Brown et al. . | |
| 4,052,323 | 10/1977 | Teneberger et al. | 508/125 |
| 4,127,491 | 11/1978 | Reick . | |
| 4,224,173 | 9/1980 | Reick . | |
| 4,252,678 | 2/1981 | Smith . | |
| 4,349,444 | 9/1982 | Reick . | |
| 4,363,737 | 12/1982 | Rodriquez | 506/123 |
| 4,405,469 | 9/1983 | Hafner et al. | 508/183 |
| 4,465,607 | 8/1984 | Cottell . | |
| 4,484,954 | 11/1984 | Tarancon . | |
| 4,500,678 | 2/1985 | Kita et al. . | |
| 4,584,116 | 4/1986 | Hermant et al. . | |
| 4,615,917 | 10/1986 | Runge . | |
| 4,657,687 | 4/1987 | Caporiccio et al. . | |
| 4,770,797 | 9/1988 | Syracuse et al. . | |
| 4,803,005 | 2/1989 | Juhlke et al. . | |
| 4,834,894 | 5/1989 | Scheld . | |
| 4,857,492 | 8/1989 | Bradley et al. . | |
| 4,859,357 | 8/1989 | Germanaud et al. . | |
| 4,888,122 | 12/1989 | McCready . | |
| 4,892,669 | 1/1990 | Marcora et al . | |
| 5,009,963 | 4/1991 | Ohmi et al. . | |
| 5,160,646 | 11/1992 | Scheld . | |
| 5,227,081 | 7/1993 | Sawa et al. | 508/126 |
| 5,350,727 | 9/1994 | Tsurumi et al. . | |
| 5,373,986 | 12/1994 | Rafferty et al. . | |
| 5,447,896 | 9/1995 | Rao . | |
| 5,460,661 | 10/1995 | Maynard, Jr. . | |

OTHER PUBLICATIONS

L.L. Cao et al. "Chemical Structure Characterization of Boundry Lubrication Film Using X–ray Photoelectron Spectroscopy and Scanning Anger Microprobe Techniques," Wear, 140 (1990), pp. 345–357.

Shaub et al., "Mechanism Studies with Special Boundary Lubricant Chemistry", Society of Automotive Engineers, Paper 952475, 1995.

Shaub et al., "Engine Durability, Emissions and Fuel Economy Studies with Special Boundry Lubricant Chemistry", Society of Automotive Engineers, Paper 941983, 1994.

Perrin et al., "Radioactive Fracer Study of Start–up Wear Versus Steady–State Wear in an2.3 Liter Engine", Socity of Automotive Engineers, Paper 952474, 1995.

*Primary Examiner*—Jacqueline V. Howard
*Attorney, Agent, or Firm*—Fulbright & Jaworski L.L.P.

[57] ABSTRACT

This invention discloses novel catalyzed lubricant additives and catalyzed lubricant systems, which contain one or more catalysts, along with optional other additives, wherein the catalysts serve to accelerate the rate and increase the yield of the lubricant bonding reactions between the catalyzed lubricants and the wear surfaces being lubricated.

53 Claims, No Drawings

CATALYZED LUBRICANT ADDITIVES AND CATALYZED LUBRICANT SYSTEMS DESIGNED TO ACCELERATE THE LUBRICANT BONDING REACTION

TECHNICAL FIELD OF THE INVENTION

This invention relates to the fields of lubricants, catalysis, organic, and inorganic chemistry, and more particularly, this invention relates to novel catalyzed lubricant additives and catalyzed lubricant systems, which contain one or more catalysts, wherein the catalysts serve to accelerate the rate and increase the yield of the lubricant bonding reactions between the catalyzed lubricants and the wear surfaces being lubricated.

BACKGROUND OF THE INVENTION

The present state of the arts are defined and illustrated by many disclosures with respect to the composition, formulation, and performance of lubricant additives, lubricant systems containing solid lubricant additives, the composition and formulation of metal coatings, the composition and formulation of catalysts, and the chemistry and performance of lubricants containing solid lubricant additives, all of which bear some relevance to the invention presented herein. Those disclosures employed as references in this patent application are listed hereinafter.

The references, other than United States Patents, are presented as follows:

L. L. Cao, Y. M. Sun, and L. Q. Zheng, "Chemical Structure Characterization of Boundary Lubrication Film Using X-ray Photoelectron Spectroscopy and Scanning Auger Microprobe Techniques," Wear, 140 (1990), pp 345–357.

Harold Shaub, John Pandosh, Anne Searle, and Stan Sprague, "Mechanism Studies with Special Boundary Lubricant Chemistry," Society of Automotive Engineers, Paper 952475, 1995.

Hal Shaub, John Pandosh, Anne Searle, Stan Sprague, and Martin Treuhaft, "Engine Durability, Emissions and Fuel Economy Studies with Special Boundary Lubricant Chemistry," Society of Automotive Engineers, Paper 941983, 1994.

Keith Perrin, John Pandosh, Anne Searle, Hal Shaub, and Stan Sprague, "Radioactive Tracer Study of Start-Up Wear Versus Steady-State Wear in a 2.3 Liter Engine," Society of Automotive Engineers, Paper 952474, 1995.

The United States Patents which bear particular relevance or are of significant interest with respect to the present patent application are singled out and are cited. See U.S. Pat. Nos. 2,230,654; 2,510,112; 2,993,567; 3,194,762; 3,247,116; 3,314,889; 3,432,431; 3,493,513; 3,505,229; 3,536,624; 3,567,521; 3,592,700; 3,607,747; 3,636,172; 3,640,859; 3,723,317; 3,806,455; 3,909,431; 3,933,656; 3,969,233; 4,029,870; 4,036,718; 4,127,491; 4,224,173; 4,252,678; 4,349,444; 4,465,607; 4,484,954; 4,500,678; 4,584,116; 4,615,917; 4,657,687; 4,770,797; 4,803,005; 4,834,894; 4,857,492; 4,859,357; 4,888,122; 4,892,669; 5,009,963; 5,160,646; 5,350,727; 5,373,986; 5,447,896; 5,460,661.

Properly designed and finished metal wear surfaces exhibit minute ridges or projections which are commonly referred to as "asperities." The asperities are a natural consequence of the metal cutting, machining, and finishing processes. Furthermore, where such wear surfaces are intended to be lubricated with liquid or semisolid lubricants, it is presently a generally accepted belief that the extension of the asperities needs to be approximately 0.1 micrometers (4 micro inches), in order to retain sufficient amounts of liquid or semisolid lubricants to protect against wear. In those cases where the wear surfaces are appropriately designed and are lubricated with liquid or semisolid lubricants, the lubricants will interpose a film between the adjacent wear surfaces and tend to protect against wear. In those instances where the liquid or semisolid film is constantly maintained on the wear surfaces, while the mechanisms being lubricated are in operation, the lubrication regime is referred to as "hydrodynamic lubrication." Hydrodynamic lubrication with properly designed lubricant systems can provide very reliable wear protection for the lubricated wear surfaces. However, in order to achieve a high level of reliability, the liquid or semisolid lubricant film must remain interposed, continuous, and of sufficient thickness between the adjacent wear surfaces, so that direct contact of the wear surfaces is prevented, or at least minimized. The appropriate design of the liquid or semisolid lubricants in providing wear protection will be predicated upon the duty with which the lubricants must contend. The duty may be determined as a function of the adjacent wear surface materials, clearances, the load imposed on the wear surfaces, the relative speed of the wear surfaces, temperatures, pressures, and other related environmental conditions.

In those cases where the wear surfaces requiring lubrication are not submerged in the lubricants, the design of the mechanisms frequently are such that lubrication is dependent upon one or more of the moving wear surfaces dragging, driving, or forcing lubricants into the areas of potential wear. The period that exists following the initial relative movement of the wear surfaces, and prior to the establishment of hydrodynamic lubrication, is referred to as the "boundary period," and the lubrication characteristics that exist during this period are referred to as "boundary lubrication."

The term "boundary" is a term of art in the mechanism and lubrication design fields handed down from an old-time British researcher who once studied journal bearings. He observed that when a shaft ceased rotating within a journal bearing, and came to rest, there was metal-to-metal contact between the shaft and the journal bearing. Thereafter, when the shaft was allowed to begin rotation again, the researcher observed that there was a "boundary period" before the lubricant applied to the journal bearing began to form a film and establish hydrodynamic lubrication.

The term "boundary lubrication," which has its roots in the study conducted by this British researcher, has been used within the Lubrication Industry ever since that time. The term is used to denote the character of lubrication that takes place with respect to adjacent wear surfaces in the time period from start-up until the time at which a continuous film of lubricant is established to effect hydrodynamic lubrication. It also denotes the character of lubrication that takes place from the time of slow down to the point where the lubricant film is lost and relative movement of the adjacent wear surfaces ceases. Boundary lubrication frequently is also associated with mechanisms which are subject to acceleration, including the acceleration due to the abrupt and rapid change of direction while in operation. Presently, the term "boundary lubrication" is often times used to refer to a regime of lubrication that is not entirely hydrodynamic.

The goal of appropriately designed mechanisms, and the programs designed to lubricate those mechanisms, is to establish and maintain a lubricant film between the adjacent wear surfaces of sufficient thickness so as to avoid or at least minimize the contact between the wear surfaces. In addition, it is the goal to minimize the energy required to move the adjacent wear surfaces in the environment of the lubricants. These goals are presently best achieved in the hydrodynamic regime of lubrication by those skilled in the arts of mechanism and lubrication design, by employing lubricants with the lowest possible viscosity permissible, wherein the separation of the adjacent wear surfaces is continuously or satisfactorily maintained.

Unfortunately, all mechanisms requiring lubrication cannot be designed so that they are maintained in a hydrodynamic lubrication regime. This is so for a variety of reasons, such as the reciprocating, or irregular motion of the mechanisms, which results in irregular rates of movement from zero to some maximum value and back to zero all in one cycle of motion. In addition, all lubricated mechanisms must start and stop operation altogether, from time-to-time, which functions produce unsteady state conditions during which periods it is difficult, if not impossible, to maintain hydrodynamic lubrication. Therefore, even though mechanisms may be optimally designed to operate with state of the art hydrodynamic lubrication most of the time, it is probable that the same mechanisms are caused to experience boundary lubrication conditions at various times in their motion or operational cycle, but it is highly probable that the mechanisms will be subjected to boundary lubrication conditions at certain times during their operational life span.

Those knowledgeable of mechanism and lubrication design and operation have long recognized that mechanisms requiring lubrication are prone to suffer a much greater rate of wear during periods of boundary lubrication than during periods of hydrodynamic lubrication, within the present state of the mechanism and lubrication design arts. The relatively high rate of wear during periods of boundary lubrication has been determined to be due to the inordinately high incidence of direct contact between the adjacent wear surfaces. This wear surface contact is most often occasioned by the loss of lubricants due to the mechanisms' acceleration. The acceleration results from simple start-up or shut-down or from rapid change in speed and rapid change in directional movement, such as centrifugal motion, sinusoidal motion, reciprocating motion, etc. This propensity for the loss of lubricant may be exacerbated by decreased lubricant viscosities at elevated operating temperatures, and by the simple gravity drainage of the lubricants away from the wear surfaces of the mechanisms during operation and following shut-down.

Based on the single consideration of minimizing energy dissipation, during hydrodynamic lubrication periods, the state of the lubrication art would mandate the use of the lowest possible viscosity liquid lubricants, that would allow the adjacent wear surfaces to hydroplane past one another, avoiding all direct contact. However, because of the inevitable periods of boundary lubrication, the relatively low viscosity liquid lubricants are known to be inadequate, without other additives, to also minimize the mechanisms' rates of wear. The present state of the art solution to this lubrication dichotomy is to employ relatively low viscosity liquid lubricants with solid lubricants suspended therein, or preferably with finely divided solid lubricant particles combined with liquid or semisolid lubricant bases, and do so in such a manner as to create colloidal systems, stable under all operating conditions.

In addition to the large number of laudable liquid and semisolid lubricants which are presently known to the lubricant art, there are solid lubricants which distinguish themselves by virtue of their relatively low coefficients of friction along with their special structural or special chemical characteristics, or both. Some of the solid lubricants which have found favor, exhibit laminar lattice structures, such as molybdenum disulfide and graphite. These structural features result in relatively low coefficients of friction, when these materials are utilized in lubricant applications. Other solid lubricants such as the various organic polymers, compounds of ethers, compounds of fatty acids and carbon, calcium, barium and lithium fluorides also exhibit relatively low coefficients of friction. In addition, these solid lubricants generally are less influenced than liquid lubricants by the adverse effects of temperature changes, in that they tend to not readily drain or be thrown from the wear surfaces being lubricated. Furthermore, in many cases solid lubricants are adsorbed, absorbed, or chemically bonded to the wear surface, frequently providing satisfactory lubrication when and where liquid lubricants alone would not do so.

The appropriately designed lubricant systems, containing solid lubricants, shall have the solid lubricants evenly distributed throughout the lubricant base media, again, preferably in stable colloidal systems, and the solid particles shall be sufficiently small as to pass readily through all of the lubrication galleries and filters, and easily gain entry to all of the interstices of the mechanisms, which the lubricant systems are designed to lubricate.

The solid lubricants generally employed as additives to liquid or semisolid base lubricants commonly pass through a series of steps whereby they are first adsorbed on the wear surfaces of the mechanisms being lubricated. Thereafter, the solid lubricants are generally absorbed within the wear surfaces, and in some cases the solid lubricants ultimately react and chemically bond to the wear surfaces to form persistent, durable films, which exhibit relatively low coefficients of friction. These three steps are deemed to be part of the comprehensive bonding reaction herein. At such time as the solid lubricants have bonded to the wear surfaces, they are expected to provide adequate lubrication during boundary lubrication periods, sufficient to prevent or reduce wear.

Some of the solid lubricants presently in service and/or proposed for service are: polytetrafluoroethylene (PTFE); Teflon® (PTFE); perfluoropolyether oxide; ethylene polymers; propylene polymers; fluorophenylene polymers; perfluoropolyether; polyol monoesters of fatty acids; amides of fatty acids; sulfurized fats and esters; molybdenum sulfur compounds; metallic soaps of fatty acids; graphite; carbon fluoride; carbon fluoride chloride; barium fluoride; calcium fluoride; and lithium fluoride. It is probable that not all of these solid lubricants are capable of progressing through the three steps cited above to reach the state where the solid lubricants are bonded to the wear surfaces. In fact, solid lubricants can be divided conveniently into two groups: unbonded solid lubricants and bonded solid lubricants.

The unbonded solid lubricants are sometimes directly applied to the surfaces to be lubricated, usually in the form of a powder, and adhere thereto by some degree of mechanical or molecular action. However, the solid lubricants in this category are, by definition, not physically or chemically bonded to the surfaces being treated in such a manner. Consequently, the properties of the solid lubricants and the fact that they are adherent but unbonded will generally serve to define the performance characteristics for any specific application. Since there is no bonding of the solid lubricants to the surfaces, in the case of unbonded solid lubricants, the potential exists, particularly in load-bearing applications, that such lubricants will be extruded from between the adjacent load-bearing wear surfaces and will not remain in position to provide the desired lubrication performance for any significant period of time. For this reason unbonded solid lubricants are considered to be useful for only nonload-bearing applications or applications where "non-stick" properties are being sought, for example cookware surfaces, cling, and stain resistant surfaces, etc.

The bonded solid lubricants are, by the definition employed herein, attached to the desired wear surfaces, generally by virtue of first adsorption, then absorption, followed thereafter by a chemical bond between the solid lubricants and the wear surfaces. The bonding often times can be effected and accelerated, or both, by the use of adhesives, binders, elevated temperatures, and other materials and techniques in appropriate applications. Generally bonded solid lubricants will present different lubrication characteristics, than those lubrication characteristics exhibited by the same solid lubricants prior to the bonding reactions. However, once the bonded lubricants are firmly affixed to the wear surfaces, they will be more persistent and much less likely to be displaced under load-bearing conditions than the unbonded lubricants. The bonded solid lubricants, in almost every case, will present a bonded interface with the lubricated wear surfaces, which will be very shallow, and as a consequence, the bonded lubricants will tend to disappear as the surfaces are subjected to unavoidable wear action, if the solid lubricants are not otherwise continuously replenished.

Irrespective of the mode of lubrication, it is easy to recognize that even under the best of conditions some wear is likely to take place with respect to adjacent wear surfaces, within the present state of the mechanism and lubrication design arts. It is acknowledged that many of the lubricant systems containing solid lubricants are and can be very effective, if the lubricant systems are maintained in good functional condition, and the lubricants are caused to immediately be self-replenishing, if and when removed from the lubricated wear surfaces.

However, it is known by one skilled in the art, that the solid lubricants contained in state of the art lubricant systems, which are subject to bonding with the wear surfaces, are very slow to effect the bond reactions. This is a significant issue, which in fact serves to diminish or maybe even negate the value of these otherwise meritorious lubricant systems in specific applications.

There is extensive literature available to confirm the function and the merits of various solid lubricants containing lubrication systems, including many of the United States Patent references cited herein. In most every case disclosed in the literature, the lubrication qualities and the wear resistance values measured and presented were derived with respect to newly formed solid lubricant films. Furthermore, general familiarity with the chemistry and physics principles involved would tend to validate the observed and reported results. However, in the actual operation of mechanisms lubricated with lubrication systems containing solid lubricants, it is inevitable that eventually both the unbonded and the bonded solid lubricants will disappear due to extrusion, erosion, corrosion, abrasion, scraping, galling, grinding, volatilization, and normal wear unless they are otherwise continuously replenished. Insofar as more solid lubricants are available in the lubricant systems, it is reasonable to expect that the solid lubricants will reestablish themselves, by again adhering or bonding to the exposed wear surfaces. However, it is known that the adhering or bonding reaction generally takes place at a relatively slow pace in the present state of the art lubricant systems. As a matter of fact, it is not unreasonable to expect that the wear surfaces subject to being lubricated with the solid lubricants are devoid of such lubricants a great deal of the time, perhaps more often than not. Nevertheless, the presence of solid lubricants in the state of the art lubricant systems generally produces a lower rate of wear than those lubricant systems with no solid lubricants present.

One of the most popular solid lubricant additives is polytetrafluoroethylene ("PTFE") which is the subject of U.S. Pat. No. 2,230,654. Since the time of U.S. Pat. No. 2,230,654, PTFE has been recognized to be a bondable solid lubricant having superior lubricating properties, primarily because of its exceptionally low coefficient of friction, and its apparent penchant to resist the adherence of other materials. Furthermore, PTFE is highly resistant to most forms of chemical attack.

Based on the research work disclosed earlier by L. L. Cao, et al., it was determined that metallic wear surfaces treated with PTFE resulted in a bonded lubrication film that could be qualitatively divided into four layers, including the outermost layer of PTFE. In fact, an oil containing PTFE was subjected to boundary lubrication conditions and when the test was completed the contacting surfaces of the metal test specimens were analyzed using X-ray Photoelectron Spectroscopy and a Scanning Auger Microprobe. The chemical state of the fluorine in the bonded boundary reaction film was shown to display four different chemical structures. The chemical structures and the related binding energies are shown in TABLE 1.

TABLE 1

| Description | Chemical Structure | Designation | Binding Energy, eV |
|---|---|---|---|
| 1. Outermost Layer | $(—CF_2—CF_2—)$ | Polytetrafluoro-ethylene | 689.72 |
| 2. Second Layer In | (—CFH—CFH—) | Polydifluoro-ethylene | 688.50 |
| 3. Third Layer In | $(—CFH—CH_2—)$ | Polymonofluoro-ethylene | 687.45 |
| 4. Metal Surface | $FeF_x$ (x = 2 & 3) | Ferrous & Ferric Fluoride | 684.42 |

It was clearly established that a multilayered boundary lubricant reaction film, with the structural layers cited above, was formed on the metallic surface. The outermost or first layer was composed of a film of PTFE. The second layer was composed of a mixed reaction film, containing a mixture of the chemical structures shown as Items 2, 3, and 4 above. The third layer exhibited a chemical structure in which there was a paucity of fluorine with respect to the second layer. The deepest layer consisted primarily of ferrous and ferric fluoride, along with some microparticles of PTFE. It is evident from the binding energy figures that each of the bonded layers was tightly bound, with the outermost layer exhibiting the greatest binding energy. The innermost layer, or the fourth layer was clearly reacted and had become part of the metallic matrix, even though its binding energy was determined to be slightly less than the other three layers.

The researchers, L. L. Cao, et al., concluded that, "under boundary lubrication, PTFE microparticles not only mechanically reduce friction, but also take part in the chemical reaction and form a multilayer structure of fluorine compounds which play an important role in antifriction and antiwear."

Those skilled in the arts of mechanism and lubrication design, and other students of engine wear behavior have long recognized that engines are prone to suffer a much greater rate of wear during start-up, as opposed to the rate of wear suffered during operation following start-up, with the present state of conventional engine lubricants. The relatively high rate of wear during start-up is attributable to the inordinately high incidence of metal-to-metal contact between the engine's adjacent wear surfaces. The inordinately high incidence of contact is occasioned by inadequate lubrication, sometimes simply due to gravity drainage of the lubricating oil away from the wear surfaces and into the engine oil pan prior to start-up.

Those engine parts having wear surfaces subject to submergence in the lubricating oil are lubricated by a hydrodynamic process which allows the adjacent wear surfaces to "hydroplane" on a film of oil, and hence, it is theoretically possible to almost completely avoid contact between the adjacent wear surfaces. Such are the conditions under which the main crankshaft bearings, the lower connecting rod bearings, and other wear surfaces submerged in the engine oil are allowed to operate. However, other wear surfaces in the engine, not submerged in the lubricating oil, are subject to boundary lubrication and/or some combination of boundary and hydrodynamic lubrication. In the case of boundary lubrication, such as that experienced by the engine piston rings, the wear surfaces are exposed to direct metal-to-metal contact and hence the rate of wear shall be very dependent upon the presence or absence of the appropriate lubricant at the points of potential contact. Realization of the manner in which lubricants function in a typical engine, and/or other mechanisms having adjacent wear surfaces, serves to emphasize the need for improved lubricant systems to enhance boundary lubrication, and consequently to reduce drag and mitigate wear.

The contemporary state of the art lubricant system using PTFE is dependent on the adherence of the PTFE on the lubricated wear surfaces, followed thereafter by metal-to-metal contact of the asperities to generate exceedingly high localized temperatures. These exceedingly high localized temperatures are deemed to be required to promote a chemical bonding reaction between the PTFE and the metallic wear surfaces being lubricated. The obvious shortcoming of this process is that the metal-to-metal contact relied upon to generate the necessary localized high temperatures deemed necessary to promote the bonding reaction, is the same metal-to-metal contact which serves to physically diminish and remove any preexisting lubricant film. That is to say the mechanical metal-to-metal collisions of the adjacent metal wear surfaces with the attendant erosion, corrosion, abrasion, scraping, galling, grinding, normal wear, and lubricant volatilization effects are probably almost as efficient in removing the lubricant film as they are in building the lubricant film. It is because of this inescapable logic and because of the test data presented in the cited references, that it is reasonable to conclude that wear surfaces lubricated with present day state of the art lubricant systems, such as the one discussed herein, are exposed without the benefits of the lubricant film, perhaps as often as they are protected by the film.

Based on the references cited herein and others, there is little or no doubt that many of the presently disclosed lubricant systems, wherein solid lubricants are contained in liquid or semisolid lubricant base materials, have proven to be more effective lubricant systems than the lubricant base materials without the solid lubricant additives. In many instances it was disclosed that the measured boundary lubrication wear rates were reduced in the order of one half, with the application of the typical contemporary lubricant system, cited herein, which system contained PTFE and other additives.

SUMMARY OF THE INVENTION

Based on the conclusions cited above concerning contemporary state of the art lubricant systems, it is not difficult to realize that there is room for improved lubricant system performance. The novel approach to achieving such improved performance, presented herein for the first time, is by adding one or more appropriately designed catalysts to the lubricant systems. The inclusion of one or more effective catalysts in the lubricant systems will serve to increase the yield of bonded lubricant film and to accelerate the bonding reactions between the wear surfaces and the solid lubricant additives, without the prerequisite of the high localized temperature. Therefore, the solid lubricant to wear surface bonding reactions may proceed under ambient conditions so that the lubricant film will rapidly form to "heal" newly exposed wear surface areas. In addition, the resultant lubricant film will thicken to the point where further metal-to-metal contact will no longer occur. It is reasonable to expect that appropriately designed catalyzed lubricant additives and/or catalyzed lubricant systems will produce a bonded lubricant film in the time the lubricated mechanism requires to make a single cycle. With the addition of an appropriately designed catalyst or catalysts to the lubricant systems containing PTFE or other effective, bondable, solid lubricant additives, it is reasonable to expect that the lubricated wear surfaces will approach full time wear protection, with a rate of wear reduction approaching 100%. In such an event the useful life of mechanisms may be greatly extended, wherein they are being lubricated with catalyzed lubricant additives and with catalyzed lubricant systems, such as the ones disclosed in this patent application. The expectations of the present invention represent major advantages over the present state of the art.

There is considerable literature available in trade publications, text books and in the United States Patent files, which demonstrate that lubricant adherence, and in some cases, lubricant bonding reactions can be accelerated by use of certain pre-treatments, such as fluoridation, and by various methods of heat treatment, and other methods. However, these methods do not lend themselves to the re-establishment of a lubricant film on most mechanisms after the manufacturing process has been completed, except in those rare cases where the mechanisms may be conveniently subjected to such treatment again and again. The novel solution to this problem is as stated above, and that is to provide appropriate additives to the lubricant systems, which will continuously function within the systems, and will act to rapidly initiate and complete the lubricant bonding reaction on all of the wear surfaces not otherwise fully bonded. The appropriate additives are catalysts that will accelerate the bonding reactions, increase the reaction yields, and be available in the lubrication system at all times.

The word "catalysis" was coined by Berzelius in 1835, at which time he provided the following definition for catalysts: "Catalysts are substances which by their mere presence evoke chemical reactions that would not otherwise take place." Wilhehn Ostwald later offered what has become the present day accepted definition for catalysts, "Catalysts are substances that change the velocity of a chemical reaction without themselves appearing in the end products." It is noteworthy that in many applications a mere trace of catalyst suffices to produce great changes without itself being changed in the final analysis. For example, U.S. Pat. No. 2,230,654, for the invention of polytetrafluoroethylene (PTFE), disclosed in Example II of the patent that: "Tetrafluoroethylene (7.8 parts) was placed in a container under pressure at 20° C. The yield of polymer after 21 days was 0.05 parts or 0.64%." Later the patent disclosed in Example VIII the results wherein a catalyst in the form of silver nitrate along with methyl alcohol were introduced, as follows: "Tetrafluoroethylene (4.5 parts) was introduced in a container with 0.1 part silver nitrate and 2.2 parts of methyl alcohol under pressures at 25° C. Polymerization began immediately with the formation of a jelly like mass. In three days this had solidified to a brown powder which had properties similar to those of the white polymer. The yield was 1.3 parts or 29%." The inclusion of the methyl alcohol and the increased temperature of 5° C. in Example VIII compared to Example II may have had a slight influence on the improved results; however, the major factor causing the reaction rate to accelerate and the yield to increase from 0.64% to 29% in only three days, rather than 21 days, was clearly the introduction of the catalyst into the reaction environment.

There are presently large numbers of industrial processes in which the use of catalysts to accelerate reaction rates and increase yields have proven to make the specific processes possible, practical, and/or economically feasible. Many such examples exist in the petroleum refining field, wherein the use of catalysts have been very successfully employed to either cause the desired reaction to go to completion in a specific time, place, and environment, and/or simply to accelerate the rates and yields of such reactions. Some of the important catalytic processes in this category are: cracking, reforming, naphthene dehydrogenation, naphthene dehydroisomerization, paraffin dehydrocyclization, paraffin isomerization, paraffin hydrocracking, olefin hydrogenation, hydrodesulfurization, and polymerization.

The function of a catalyst has been likened to that of a coin inserted in a slot machine that yields valuable products and also returns the coin. In a catalyzed reaction the catalyst enters at one stage and leaves at another stage. Catalysts may be of any composition and may be of any phase (i.e. solid, liquid, or gaseous). Catalysts that are of the same phase as the reactants are termed "homogeneous," and catalysts that are of a different phase than the reactants are referred to as "heterogeneous."

Many reactions that proceed slowly under some specific conditions of temperature, pressure, concentration, and environment can be speeded up significantly by the addition of a small amount of catalyst, as was illustrated by U.S. Pat. No. 2,230,654. These catalytic substances act to increase reaction rates, and reaction yields, sometimes by providing a new mechanism of reaction at lower activation energy levels, and sometimes by affording a surface on which reactants are adsorbed, and in so doing, they serve to facilitate the reaction. Those skilled in the art of catalysis are well familiar with the fact that appropriately designed catalysts added to the environment of the reactants can greatly improve the functionality of specific reactions. However, the state of the art of catalysis is such that there are many unanswered questions about the role of catalysts, and these unanswered questions provide many interesting research areas. The only safe generalizations about catalytic behavior are that a definite increase in reaction rate is produced, and that the catalyst can be, theoretically, completely recovered when the reaction goes to completion.

The present invention consists of novel concepts, complete with a group of formulations for catalyzed lubricant additives, and for catalyzed lubricant systems. The catalyzed lubricant additives of this invention are comprised of items 1 and 2 below, and one or more of the remaining numbered items, presented as follows:

Catalyzed Lubricant Additives

1. Base lubricant,
2. One or more catalysts,
3. One or more catalysts, or any combination of catalysts, wherein the catalysts consist of one or more transition elements, and/or one or more compounds, in which one or more transition elements are included,
4. Any number of additives,
5. Any number of additives, wherein one or more of the additives are solid lubricants,
6. Any number of additives, wherein one or more of the additives are selected from the group consisting of PTFE, other polymers, ethers, fatty acid compounds, molybdenum compounds, metallic soaps, graphite, carbon halogens, barium fluoride, calcium fluoride, and lithium fluoride,
7. One or more halogen elements, or any combination of halogen elements, and/or one or more compounds in which halogen elements are included, and
8. One or more catalysts, where such catalysts are homogeneous, heterogeneous, or any combination of homogeneous and heterogeneous catalysts.

Catalyzed Lubricant Systems

The catalyzed lubricant systems of this invention are comprised of the catalyzed lubricant additives of this invention included in any base lubricant.

An object of this invention is to establish and restore the protective lubricant film on lubricated wear surfaces as rapidly as possible, thereby preventing or minimizing the opportunity for the adjacent wear surfaces to come into contact with one another.

An object of this invention is to provide one or more novel additives, specifically including catalysts, for use as admixes with base lubricants, in particular base lubricants comprised of liquid or semisolid base materials, with solid lubricant materials included therein, wherein the additives are designed to accelerate the rate of the bonding reaction and increase the yield of the bonding reaction between the catalyzed lubricants and the wear surfaces being lubricated with the above described lubricant systems.

An object of this invention is to define the composition of a group of catalysts for use as lubricant additives, as cited above, as one or more transition elements, or one or more compounds in which transition elements are included, or any combination of transition elements and transition element compounds, where the transition elements are identified as those elements bearing atomic numbers 21 through 31, 39 through 49, and 71 through 81, all inclusive.

An object of this invention is to define the ingredients for various catalytic lubricant additives and various catalytic lubricant systems wherein the ingredients include conventional mineral oil or grease, or synthetic oil or grease, or any other base lubricant, whether or not such lubricants have been presently disclosed, and with the catalyst additives cited above.

An object of this invention is to include additional lubricant system additives, which additives are designed to improve and enhance the catalyzed lubricant system to which they are admixed.

An object of this invention is to include one or more of the halogen elements and/or compounds in which halogen elements are included, to function as starters and to contribute to the mass effect of the catalyzed lubricant bonding reactions and resultant lubricant film formation.

DESCRIPTION OF THE INVENTION

As was discussed previously, one of the most effective solid lubricant additives for general lubrication purposes is PTFE. For this reason, one of the preferred embodiments of this invention is a catalyzed lubricant additive which contains PTFE and has the following formulation.

TABLE 2

Preferred Embodiment of Lubricant Base.

| | Ingredients | Weight % |
|---|---|---|
| 2.1 | Dispersant<br>Polymer-Amine | 6.00 |
| 2.2 | Detergent-Alkaline Agent<br>High Base Phenate | 0.50 |
| 2.3 | Detergent-Antioxidant<br>Low Base Phenate | 1.50 |
| 2.4 | Primary Detergent<br>Low Base Sulfonate | 1.50 |
| 2.5 | Rust Inhibitor<br>High Base Sulfonate | 0.50 |
| 2.6 | Antioxidant-Antiwear<br>Zinc Dialkyldithiophosphate | 1.50 |
| 2.7 | Viscosity Modifier<br>Ethylene-Propylene Copolymer | 10.00 |
| | Subtotal | 21.50 |
| 2.8 | Base Oil<br>High quality petroleum lube stock | 78.50 |
| | Total | 100.00 |

TABLE 3

Preferred Embodiment of Catalytic Lubricant Additive.

| | Ingredients | | Weight % |
|---|---|---|---|
| 3.1 | Lubricant base<br>TABLE 2, above | | 89.00 |
| 3.2 | Dispersant<br>Polymer Amine | | 6.00 |
| 3.3 | PTFE, Colloidal Particles*<br>Stable Colloidal System** | | 4.0 |
| 3.4 | Hydrofluorocarbon oil | | 1.00 |
| | Subtotal | | 100.00 |
| 3.5 | Platinum, Colloidal Particles*<br>Stable Colloidal System** | 3.12 ppm*** | — |
| 3.6 | Palladium, Colloidal Particles*<br>Stable Colloidal System** | 97.70 ppm*** | — |
| | Total | | 100.00 |

*"Colloidal Particles" are defined as particles having diameters ranging from 1 micrometer to 1 nanometer.

** A "Stable Colloidal System" is defined as a system composed of colloidal particles dispersed in some medium, wherein the particles remain suspended because the force due to gravity is offset by the kinetic energy or "brownian movement" inherent in the system.

***"ppm," abbreviation for parts per million, by weight. More specifically in this case, parts of catalyst per million parts of other materials in the mixture, by weight. The concentrations of platinum and palladium specified here are so small as to not effect the "Total" value, within the number of significant figures shown.

TABLE 4

Preferred Embodiment of Catalytic Lubricant System

| | Ingredients | Weight % |
|---|---|---|
| 4.1 | Lubricant Base<br>TABLE 2, above | 80.00 |
| 4.2 | Catalytic Lubricant Additive<br>TABLE 3, above | 20.00 |
| | Total | 100.00 |

Previously, the research findings of L. L. Cao, et al., with respect to the analysis of a bonded lubrication film were presented. In that case the bonded lubrication film was found to have been developed following the application of a lubricant system, which included PTFE along with other additives, to the wear surfaces of an engine. The bonded lubricant film was shown to contain four distinguishable layers.

It is postulated that in the presence of the appropriate catalysts of this invention, the first reaction that will occur in the development of the lubricant film is the severance of some of the fluorine-carbon bonds with respect to the PTFE. Thereafter, it is postulated that the fluorine radicals will attach to the lubricated wear surface, which in the case analyzed by L. L. Cao, et al., the lubricated wear surfaces were iron (Fe). This step results in the temporary formation of the ferric fluoride compounds represented by the formulas $FeF_4^{-1}$ and/or $FeF_6^{-3}$. These compounds are highly reactive and hence unstable. It is further postulated that these ferric fluoride compounds then bond with the degraded products of the PTFE represented above as the "chemical structure" for the "Third Layer In," thereby establishing the critical bond between the iron wear surface and the degraded PTFE, or polymonofluoroethylene solid lubricant film.

The progression of in situ chemical reactions postulated to develop the same four layers of lubricant film as those identified by L. L. Cao, et al., as cited above, are shown as follows, but now with respect to the preferred embodiment of this invention which includes the presence of platinum and palladium, heterogeneous catalysts in the environment of the reactions:

1. Outermost Layer.

1.1 Absorption of Polytetrafluoroethylene:

$$(-CF_2-CF_2-)$$
PTFE

-continued

2. Second Layer In.

2.1 Dehydrogenation of Base Oil:

$$\underset{\text{n-decane}}{C_{10}H_{22}} \xleftrightarrow[\text{catalyst}]{\text{platinum \& palladium}} \underset{\text{n-decane}}{C_{10}H_{22}} + \underset{\text{hydrogen}}{2H}$$

2.2 Severance of Fluorine-Carbon Bonds and First Stage Hydrogenation of PTFE:

$$\underset{\text{PTFE}}{(-CF_2-CF_2-)} + \underset{\text{hydrogen}}{2H} \xleftrightarrow[\text{catalyst}]{\text{platinum \& palladium}} \underset{\text{polydifluoroethylene}}{(-CFH-CFH-)} + \underset{\text{fluorine}}{2F}$$

3. Third Layer In.

3.1 Dehydrogenation of Base Oil:

$$\underset{\text{n-decane}}{C_{10}H_{22}} \xleftrightarrow[\text{catalyst}]{\text{platinum \& palladium}} \underset{\text{n-decane}}{C_{10}H_{22}} + \underset{\text{hydrogen}}{2H}$$

3.2 Added Severance of Fluorine-Carbon Bonds and Second Stage Hydrogenation of PTFE:

$$\underset{\text{polydifluoroethylene}}{(-CFH-CFH-)} + \underset{\text{hydrogen}}{H} \xleftrightarrow[\text{catalyst}]{\text{platinum \& palladium}} \underset{\text{polymonofluoroethylene}}{(-CFH-CH_2-)} + \underset{\text{fluorine}}{F}$$

4. Metal Surface.

4.1 Polymonofluoroethylene Bonding Reaction with Iron and Fluorine:

$$\underset{\text{iron}}{2Fe} + \underset{\text{fluorine}}{4F} + \underset{\text{polymono-fluoroethylene}}{(-CFH-CH_2-)} \xleftrightarrow[\text{catalyst}]{\text{platinum \& palladium}} \underset{\text{ferric fluoride-polymono-fluoroethylene bonded}}{FeF_2(-CFH-CH_2-)FeF_2}^{*}$$

4.2 Fluorine Reaction with Ferrous Iron:

$$\underset{\text{iron}}{Fe} + \underset{\text{fluorine}}{2F} \xleftrightarrow[\text{catalyst}]{\text{platinum \& palladium}} \underset{\text{ferrous fluoride}}{FeF_2}$$

4.3 Fluorine Reaction with Ferrous Fluoride:

$$\underset{\text{ferrous flouride}}{FeF_2} + \underset{\text{fluorine}}{F} \xleftrightarrow[\text{catalyst}]{\text{platinum \& palladium}} \underset{\text{ferric fluoride}}{FeF_2}$$

* In the "Metal Surface" reaction 4.1 above, the reaction products could be as shown, or could be one or a combination of reaction products selected from a group consisting of the following:

4.1.1 $Fe(-CF_2-CF_2-)_2$,
4.1.2 $Fe(-CF_2-CFH-)_2$,
4.1.3 $Fe(-CFH-CFH-)_2$,
4.1.4 $Fe(=CF-CFH-)$,
4.1.5 $Fe(=CF-CF=)$,
4.1.6 $FeF(-CF_2-CF_2-)$,
4.1.7 $FeF(-CFH-CH_2-)$,
4.1.8 $Fe(-CF_2-CF_2-)_3$,
4.1.9 $Fe(-CF_2-CFH-)_3$,
4.1.10 $Fe(-CFH-CFH-)_3$,
4.1.11 $2Fe(=CF-CFH-)_3$,
4.1.12 $2Fe(=CF-CF=)_3$, and
4.1.13 $FeF_2(-CF_2-CF_2-)$.

The same type of reaction is postulated wherein the lubricated wear surface is any one of the materials out of which lubricated wear surfaces are commonly constructed. In view of the fact that fluorine is the most electronegative element and the most reactive nonmetal known, it is postulated that it will react with virtually any material of which the lubricated wear surface may be constructed. Furthermore, it is anticipated that the progression of the in situ chemical reactions, postulated for the case wherein the lubricated wear surface was constructed of iron, will be the same except that the symbol for the alternate lubricated wear surface material will replace the symbol for iron (Fe), and the combining ratios will be appropriately adjusted.

The presence of the platinum and palladium, functioning as a catalyst in each reaction of the preferred embodiment of the invention cited above, serves to accelerate the reaction, to cause the reactions to exhibit a greater yield, and to allow the reactions to go to completion more rapidly under ambient conditions.

Although the invention has been described in conjunction with a specific embodiment, it is evident that many alternatives, modifications, variations, and permutations will be apparent to those skilled in the relevant arts, in light of the foregone descriptions and discussions. Other embodiments will become apparent to those skilled in the relevant arts from a consideration of the concept, scope, spirit, specifications, and/or practices of the invention. It is contended that the alternatives, modifications, variation, and permutations of this invention may be practiced, without departing from the concept, scope or spirit of the invention disclosed herein. Accordingly, it is contended that the invention is not confined to the particular embodiments, formulations, and reactions presented herein, but rather the invention embraces such alternatives, modifications, variations, and permutations, and all other forms thereof as shall come within the scope of the Claims presented hereinafter.

All the preceding references are hereby incorporated by this reference.

What is claimed and desired to be secured by United States Letter Patent is:

1. Lubricant additive composition comprising a base lubricant means, admixed with at least one catalyst means in an amount to act only as a catalyst, wherein the catalyst means is at least one of the following: homogenous, heterogeneous, and homogeneous and heterogenous, and wherein the additive composition may include other additive means.

2. Lubricant composition comprising any base lubricant means, admixed with any number, including zero, of other additive means, and admixed with at least one transition catalyst means, the catalyst means being only in an amount sufficient to accelerate the rate of bonding with a wear surface, wherein the catalyst means is at least one of the following: homogeneous, heterogeneous, and both homogeneous and heterogeneous.

3. Lubricant composition comprising any base lubricant means admixed with at least one solid lubricant means, and admixed with any number, including zero, of other additive means, not including said solid lubricant means, and admixed with at least one transition element catalyst means.

4. Lubricant composition comprising any base lubricant means admixed with at least one solid lubricant means, and admixed with any number, including zero, of other additive means, not including solid lubricant means, admixed with halogen means, and admixed with at least one catalyst means.

5. Lubricant composition comprising any base lubricant means, admixed with at least one solid lubricant means and admixed with any number, including zero, of other additive means, not including said solid lubricant means, admixed with fluorine means, and admixed with at least one catalyst means.

6. A transition metal catalytic lubricant additive composition for enhancing bonding of lubricants to surfaces, comprising:

platinum in weight percent equal to or less than 1/100;

palladium in weight percent equal to or less than 1/100; and wherein the remainder of the composition is a lubricant which may include additives.

7. A catalytic lubricant system composition comprising:

a transition metal catalyst composition comprising platinum in weight percent equal to or less than 1/100, and palladium in weight percent equal to or less than 1/100; and a lubricant base.

8. A method for rapidly establishing or restoring a protective lubricant film on wear surfaces comprising the steps of:

combining a transition metal catalytic lubricant additive composition comprising platinum in weight percent equal to or less than 1/100, palladium in weight percent equal to or less than 1/100, and with a base lubricant to form a mixture; and causing said mixture to be contacted with a wear surface.

9. The method of claim 8 wherein said platinum and palladium are in colloidal form.

10. The method of claim 8 wherein said platinum and palladium are present in the weight ratio of approximately 3 to 98 with respect to each other, respectively.

11. The method of claim 10 wherein said platinum and palladium are in colloidal form and further remain suspended in a surrounding medium.

12. The method of claim 8 further comprising a dispersant.

13. The method of claim 12 wherein said dispersant is a polymer-amine.

14. The method of claim 8 further comprising polytetrafluoroethylene colloidal particles.

15. The method of claim 12 wherein said polytetrafluoroethylene colloidal particles remain suspended in a surrounding medium.

16. The method of claim 15 further comprising hydrofluorocarbon oil.

17. The transition metal catalytic lubricant additive composition of claims 6 or 7 wherein both said platinum and said palladium are in colloidal form and exist as a stable colloid in a surrounding medium; and wherein said transition metal catalytic lubricant additive composition further comprises:

a polymer-amine dispersant;

polytetrafluoroethylene colloidal particles; and hydrofluorocarbon oil.

18. The transition metal catalytic lubricant additive composition of claims 6 or 7 wherein said composition is present in a catalytic lubricant system at a weight percent of between about 5% to about 25%.

19. The catalytic lubricant system composition of claim 7 wherein said catalytic lubricant composition comprises between about 5% to about 25% of said catalytic lubricant system composition by weight.

20. The catalytic lubricant system composition of claim 7 wherein said transition metal catalyst composition further comprises:

polymer-amine dispersant comprising about 6% by weight of said lubricant system;

polytetrafluoroethylene colloidal particles comprising about 4% by weight of said lubricant system;

hydrofluorocarbon oil comprising about 1% by weight of said lubricant system; and platinum and palladium in colloidal form comprising about 100 parts per million of said lubricant system.

21. The catalytic lubricant system composition of claim 7 wherein said lubricant base is comprised of: a base oil, a dispersant, a detergent-alkaline agent, a detergent-antioxidant, a primary detergent, a rust inhibitor, an antioxidant-antiwear compound, and a viscosity modifier.

22. The catalytic lubricant system composition of claim 21 wherein said base oil is selected from the group comprising: conventional mineral oil, synthetic oil, conventional mineral grease, and synthetic grease.

23. The catalytic lubricant system composition of claim 7 wherein said catalytic lubricant system is comprised of:

a base oil;

a polymer-amine dispersant;

a high-base phenate detergent alkaline agent;

a low-base phenate detergent antioxidant;

a low-base sulfonate primary detergent;

a high-base sulfonate rust inhibitor;

a zinc dialkyldithiophosphate antioxidant antiwear compound; and an ethylene-propylene copolymer viscosity modifier.

24. The catalytic lubricant system composition of claim 7 wherein said lubricant:

base has a weight percent of about 78.5% of said total lubricant system mixture; said catalytic lubricant system further including:

a polymer-amine dispersant having a weight percent of about 7%;

a high-base phenate detergent alkaline agent having a weight percent of about 0.5%;

a low-base phenate detergent antioxidant having a weight percent of about 1.5%;

a low-base sulfonate primary detergent having a weight percent of about 1.5%;

a high-base sulfonate rust inhibitor having a weight percent of about 0.5%;

a zinc dialkyldithiophosphate antioxidant antiwear compound having a weight percent of about 1.5%; and an ethylene-propylene copolymer viscosity modifier having a weight percent of about 10%.

25. The transition metal catalytic lubricant additive composition of claim 6 wherein said transition metal catalytic lubricant additive composition further comprises:

a polymer-amine dispersant;

polytetrafluoroethylene colloidal particles;

hydrofluorocarbon oil; and said lubricant base further comprises:

a base oil;

a dispersant;

a detergent-alkaline agent;

a detergent-antioxidant;

a primary detergent;

a rust inhibitor;

an antioxidant-antiwear compound; and a viscosity modifier.

26. The method of promoting a chemical bonding between a lubricant and the surface to be lubricated, the method comprising the steps of:

selecting a base lubricant;

mixing with said base lubricant at least one catalyst in an amount sufficient only to act as a catalyst to accelerate such chemical bonding; and bringing said mixture into contact with the surface to be lubricated.

27. The method set forth in claim 26 wherein said transition element is under 1/100 of said lubricant.

28. The method set forth in claim 26 wherein said lubricants are selected from the group consisting of: polytetrafluoroethylene (PTFE), Teflon® (PTFE), perfluoropolyether oxide, ethylene polymers, propylene polymers, fluorophenylene polymers, perfluoropolyether, polyol monoesters of fatty acids, amides of fatty acids, sulfurized fats and esters, molybdenum sulfur compounds, metallic soaps of fatty acids, graphite, carbon fluoride, carbon fluoride chloride, barium fluoride, calcium fluoride, and lithium fluoride.

29. The method set forth in claim 26 wherein said catalyst is one or more of the elements selected from the group consisting of: scandium, titanium, vanadium, chromium, manganese, iron, cobalt, nickel, copper, zinc, gallium, yttrium, zirconium, niobium, molybdenum, technetium, ruthenium, rhodium, palladium, silver, cadmium, indium, lutetium, hafnium, tantalum, tungsten, rhenium, osmium, iridium, platinum, gold, mercury, thallium.

30. The method set forth in claim 26 wherein said transition element catalyst is comprised of one or more compounds, said compounds in turn comprised of an element or elements selected from the group of compounds consisting of: scandium, titanium, vanadium, chromium, manganese, iron, cobalt, nickel, copper, zinc, gallium, yttrium, zirconium, niobium, molybdenum, technetium, ruthenium, rhodium, palladium, silver, cadmium, indium, lutetium, hafnium, tantalum, tungsten, rhenium, osmium, iridium, platinum, gold, mercury, thallium.

31. The method set forth in claim 26 wherein said lubricant base is present at a concentration of about 75% to about 95% by weight.

32. The method set forth in claim 26 further including the step of:

adding colloidal particles to said mixture.

33. The method set forth in claim 32 wherein said colloidal particles have a mean diameter of less than 1 micrometer.

34. A method for providing lubrication between two surfaces, said method including the steps of:

placing a lubricating base on at least one of said surfaces, and exposing said lubricating base to a catalyst in an amount only sufficient for catalytic purposes for accelerating a chemical bond between said lubricating base and at least one of said surfaces.

35. The method of claim 34, wherein said catalyst is a transition element.

36. The method of claim 34, wherein said catalyst amount is less than 1/10 by weight of said lubricating base.

37. The method of claim 34, wherein said catalyst amount is premixed into said lubricating base.

38. A lubricant system comprising:

a lubricant base, and a catalytic lubricant additive in an amount only necessary to promote bonding of the lubricant system with the surface to be lubricated.

39. The lubricant system of claim 38, wherein said catalytic lubricant additive includes any transition element.

40. The lubricant system of claim 39, wherein said transition element is at least one of platinum and palladium in an amount under 1/100 by weight.

41. The lubricant system of claim 39, wherein said base is 80% by weight and said additive is 20% by weight.

42. The method of increasing the rate and yield of bonding of a material with respect to a surface to which said material is to come into contact with said method comprising the steps of:

bringing said material into contact with a catalytic element to form a combination of said material with at least some of said catalytic element; and bringing said combined element into contact with said surface.

43. The method of claim 42 wherein said contact is substantially momentary.

44. The method of claim 42 wherein said contact is relatively permanent.

45. The method of claim 42 wherein said combination contains less than 1/100% by weight of said catalytic element.

46. The method of claim 42 wherein said catalytic element is a transition element.

47. The lubricant additive composition of claim 1, wherein said at least one catalyst means provides in situ lubricant bonding means, which lubricant bonding means results in accelerated lubricant bonding reactions and increased lubricant bonding yield when compared to said base lubricant means alone, wherein lubricant bonding refers to the bonding between the admixture and the surface being lubricated, wherein said bonding means includes at least one of the bonding types selected from the group consisting of adsorption, absorption, ionic bonding, covalent bonding, coordinate bonding and electrovalent bonding.

48. The lubricant additive composition of claim 1, wherein said base lubricant means to which the lubricant additive composition is admixed includes any number of other additive means, wherein at least one of the other additive means is a solid lubricant means, selected from the group consisting of polytetrafluoroethylene, molybdenum sulfur compounds, perfluoropolyether oxide, metallic soaps of fatty acids, ethylene polymers, graphite, propylene polymers, carbon fluoride, fluorophenylene polymers, carbon fluoride chloride, perfluoropolyether barium fluoride, polyol monoesters of fatty acids, calcium fluoride, amides of fatty acids, lithium fluoride and sulfurized fats and esters.

49. The lubricant additive composition of claim 1, wherein said at least one catalyst means includes at least two catalytic ingredients, wherein at least one of the catalytic ingredients is homogeneous, and wherein at least one of the catalytic ingredients is heterogeneous, wherein homogeneous is defined as being of the same phase as the base lubricant means, and heterogeneous is defined as being of a different phase than the base lubricant means to which the lubricant additive composition is admixed, wherein phase refers to the state of the lubricant additive composition as in solid, liquid, and gaseous states.

50. The lubricant additive composition of claim 1 wherein said at least one catalyst means comprises:

polymer-amine dispersant comprising about 6% by weight of said lubricant system;

polytetrafluoroethylene colloidal particles comprising about 4% by weight of said lubricant system;

hydrofluorocarbon oil comprising about 1% by weight of said lubricant system; and platinum and palladium in colloidal form comprising about 100 parts per million of said lubricant system.

51. The lubricant additive composition of claim 1 wherein said base lubricant means is a base oil; and wherein said other additive means comprises:

a polymer-amine dispersant;

a high-base phenate detergent alkaline agent;

a low-base phenate detergent antioxidant;

a low-base sulfonate primary detergent;

a high-base sulfonate rust inhibitor;

a zinc dialkyldithiophosphate antioxidant antiwear compound; and an ethylene-propylene copolymer viscosity modifier.

52. The lubricant additive composition of claim 1 wherein about 78.5% of any admixture of said base lubricant means and said other additive means is a base oil; and where about 21.5% of any admixture of said base lubricant means and said other additive means is said other additive means and wherein said other additive means comprises:

a polymer-amine dispersant having a weight percent of about 7%;

a high-base phenate detergent alkaline agent having a weight percent of about 0.5%;

a low-base phenate detergent antioxidant having a weight percent of about 1.5%;

a low-base sulfonate primary detergent having a weight percent of about 1.5%;

a high-base sulfonate rust inhibitor having a weight percent of about 0.5%;

a zinc dialkyldithiophosphate antioxidant antiwear compound having a weight percent of about 1.5%; and an ethylene-propylene copolymer viscosity modifier having a weight percent of about 10%.

53. The lubricant additive composition of claim 1 wherein said base lubricant means is a base oil;

wherein said at least one catalyst means comprises:

a polymer-amine dispersant;

polytetrafluoroethylene colloidal particles; and hydrofluorocarbon oil; and wherein said other additive means comprises:

a dispersant;

a detergent-alkaline agent;

a detergent-antioxidant;

a primary detergent;

a rust inhibitor;

an antioxidant-antiwear compound; and a viscosity modifier.

* * * * *